US007465153B2

(12) United States Patent
Addie et al.

(10) Patent No.: US 7,465,153 B2
(45) Date of Patent: Dec. 16, 2008

(54) DIVERTER FOR REDUCING WEAR IN A SLURRY PUMP

(76) Inventors: Graeme R. Addie, 3547 Vellerive Cir., Martinez, GA (US) 30907; Thomas Mueller, 335 Cold Springs Ct., Grovetown, GA (US) 30813; Stephan Bross, Am Erlengraben 7, D-67167 Erpolzheim (DE); John Maffett, 1409 Hadden Blvd., Avera, GA (US) 30803

( * ) Notice: Subject to any disclaimer, the term of this patent is extended or adjusted under 35 U.S.C. 154(b) by 812 days.

(21) Appl. No.: 10/212,919

(22) Filed: Aug. 6, 2002

(65) Prior Publication Data

US 2003/0044272 A1 Mar. 6, 2003

Related U.S. Application Data

(60) Provisional application No. 60/310,883, filed on Aug. 8, 2001.

(51) Int. Cl.
*F04D 29/08* (2006.01)

(52) U.S. Cl. ..... 415/172.1; 415/196

(58) Field of Classification Search ..... 415/1, 415/171.1, 172.1, 173.1, 196
See application file for complete search history.

(56) References Cited

U.S. PATENT DOCUMENTS 3,620,642 A * 11/1971 Studebaker et al. ..... 415/172.1
3,881,840 A 5/1975 Bunjes ..... 415/109
5,984,629 A 11/1999 Brodersen et al. ..... 415/172.1

OTHER PUBLICATIONS

Aufbereitungs Technik 41 (2000) Nr. 6, pp. 296-298, "A New Cost-Efficient Slurry Pump from Krebs.".*

* cited by examiner

*Primary Examiner*—Richard Edgar
(74) *Attorney, Agent, or Firm*—Womble Carlyle Sandridge & Rice, PLLC

(57) ABSTRACT

Disclosed is a diverter for directing particles that cause wear in a slurry pump away from the stationary face of a slurry pump. The diverter comprises a protrusion that directs particles back into the collector of the pump to reduce the number of particles that go through the impeller nose gap. The protrusion extends from the suction liner face to the front shroud whereby particles can be deflected away from the suction liner face.

7 Claims, 3 Drawing Sheets

DIVERTER FOR REDUCING WEAR IN A SLURRY PUMP

RELATED APPLICATION

This application is a non-provisional application claiming the benefit of Provisional Application Ser. No. 60/310,883, filed Aug. 8, 2001, the content of which is hereby incorporated in its entirety.

FIELD OF THE INVENTION

The present invention generally relates to a slurry pump for use in pumping a slurry and in particular to a diverter for directing particles away from a stationary face and impeller nose gap to reduce wear.

BACKGROUND

Slurry pumps are often configured as centrifugal pumps, which employ centrifugal force to lift liquids from a lower to a higher level or to produce a pressure. Basically, a slurry pump comprises an impeller consisting of a connecting hub and shrouds with a number of vanes rotating in a volute collector or casing. Liquid is led into the center of the impeller and is picked up by the vanes and accelerated to a high velocity by the rotation of the impeller and discharged by centrifugal force into the casing and out the discharge. When liquid is forced away from the center, a vacuum is created and more liquid flows in. Consequently there is a flow through the pump.

Centrifugal pumps may be configured as single stage, single suction pumps having an impeller connected to a shaft and sandwiched between a front and back shroud. The rotation of the impeller vanes results in a higher pressure in the volute collector or shell than in the suction, which results in a flow. The higher pressure zone of the volute collector is sealed against the low pressure zone of the suction where the shaft (at a lower atmospheric pressure) enters the collector to avoid leakage losses and loss of performance. On the front or suction side, the most common method of sealing is to use a close radial clearance between the impeller and the casing.

The solids/liquid mixture moved through the slurry pump induces great wear and shortens the pump's life. Wear occurs mostly as a result of particles impacting on the wetted surfaces. The amount of wear depends on the particle size, shape, specific gravity of the solids hardness and sharpness most of which is dictated by the service and the velocity of the impacts and the number (or concentration) of impacts.

In the front sealing gap area, there is relatively high velocity between the stationary liner surfaces and the rotating impeller surfaces and a restricted area, which increases those relative velocities and the number of particles in a given location. Particles being thrown off a rotating radial surface can cause high wear on any close stationary radial surface and that it is better to have an axial (or semi axial) sealing gap.

Various methods have been devised to reduce the wear on the nose gap area. For example, to decrease wear some designs employ a water flush as shown, while others utilize semi axial gaps tapering inwards at some angle to the vertical and still others utilize front clearing vanes protruding out of the front shroud of the impeller into the gap between the impeller and the suction liner.

The front clearing vanes develop a pressure similar to the impeller vanes. The clearing vanes pump the leakage flow from the collector to the suction, thereby reducing wear in the nose gap area. However, it is difficult to maintain a close clearance between the suction liner and the clearing vanes, allowing a gap that particles can use to travel down the surface of the suction liner and through the nose gap. Depending on the clearances, there is a small flow recirculating in the gap between the shrouds and the suction liner and depending on the size of the clearing vanes an even smaller flow across the nose gap.

In spite of using wear resistant materials and various methods for reducing wear, there remains a need for reducing the wear in the high wear areas of a centrifugal slurry pump.

SUMMARY

The present invention includes a diverter for directing particles that cause wear in a slurry pump away from the stationary face of a slurry pump. The diverter comprises a protrusion that directs particles back into the collector of the pump to reduce the number particles that go through the impeller nose gap.

In greater detail, the diverter for reducing wear on a slurry pump comprises an impeller front shroud and a suction liner face operatively opposed to the impeller front shroud wherein a protrusion extends from the suction liner face to about the front shroud whereby particles can be deflected away from the suction liner face. Furthermore, the impeller front shroud may comprise clearing vanes that can include a relief. The protrusion can extend and fit within the relief to further aid in directing the particles to the clearing vanes. Typically, the gap formed between the protrusion and the impeller front facing ranges from about 0.5 mm to about 2.5 mm. The protrusion is placed upstream of the impeller nose gap such that the number of particles that pass through the nose gap is reduced.

In a further embodiment, the invention includes a diverter for decreasing the number of particles that pass through an impeller nose gap of a slurry pump by diverting the particles to an impeller front shroud having clearing vanes. The diverter comprises a suction liner face operatively opposed to the impeller front shroud and a protrusion extending from the suction liner face and towards the front shroud whereby particles can be deflected away from the suction liner face and into the clearing vanes. The clearing vanes further include a relief with the protrusion extending out and into the relief formed within the clearing vanes. The protrusion can include an outer edge and an inner edge. Typically, the outer edge is substantially rounded and the inner edge slopes at an angle of about 45 degrees.

Additionally, the invention includes a method for decreasing the number of particles that pass through an impeller nose gap of a slurry pump by clearing a portion of particle laden liquid from the impeller nose gap. The method includes the steps of diverting the portion of particle laden liquid to a clearing area and pumping the diverted particle laden liquid from the clearing area and into a main volute collector. The diverted particle laden liquid may be pumped using centrifugal force. Additionally, the method includes diverting the portion of particle laden liquid away from a suction liner face.

DETAILED DESCRIPTION

Figure 1:
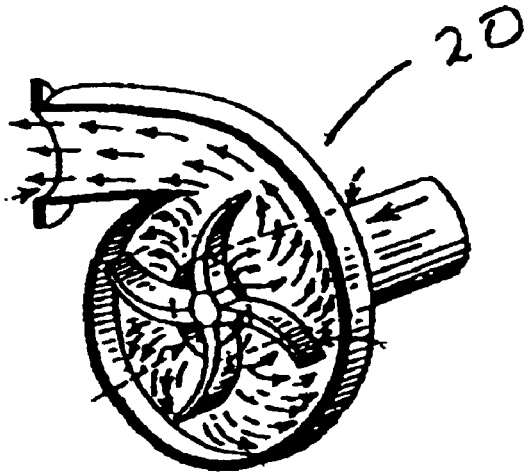
Fig. 1 PRIOR ART
FIG. 1 is a cross-section of a known centrifugal pump.

The present invention includes a diverter 2 for directing particles away from the stationary face or suction liner 4 of a slurry pump 20 and away from the impeller nose gap 12. By diverting particles away from the nose gap 12, wear is reduced. The diverter 2 comprises a protrusion that extends out from the suction liner 4 and directs particles back into the collector 22 of the pump to reduce the number of particles that pass through the impeller nose gap 12. The diverter 2 extends out a distance nearly equal to the distance between the suction liner 4 and the impeller front shroud 10 such that the clearance between the diverter 2 and impeller front shroud 10 is kept at a minimum.

In greater detail, the diverter 2 directs the slurry and particles that cause wear away from the stationary face of the suction liner 4 to a location where the suction of the clearing vanes 8 can catch the particles and by a centrifugal force, pump them back into the collector 22. By pumping the particles back into the collector 22, the wear on the nose gap 12 is greatly reduced since a large portion of the particles that would normally pass through the gap 12 are pumped back into the collector 22.

The clearing vanes 8 may be stopped off short of the nose of the impeller to provide a relief at the inside. The diverter 2 can be positioned to fit within the relief 19 to urge the particles towards the inlet of the clearing vanes 8 and away from the stationary face of the suction liner 4. By urging the particles into the suction area of the front clearing vanes 8, the particles can be pumped back into the volute collector 16. The heavier particles tend to be caught up in the clearing vanes 8 as they are brought close enough. Depending on how close the particles are brought, the size of the clearing vanes 8 and the size of the particles are significantly reduced and a number of particles will find their way through the gap into the suction thereby reducing wear in the high wear nose 12 face area.

Depending on the size of the pump, the clearance between the clearing vanes 8 and the suction liner 4 is about 2 mm for a pump with an impeller 18 of 1 meter. Smaller diameter impeller pumps can achieve tighter clearances of about 1 mm in the case of 0.5-meter diameter impeller. Impellers 18 with diameters larger than 1 meter have proportionally larger front clearances.

The impeller front shroud thickness is usually a function of the severity of the wear service and the size of the parts. A method that is used says that for heavy duty service the shroud should be =0.75(1.24 =0.024D) inches where D is the impeller diameter in inches. From this it can be seen that a 20 inch (0.5-meter) diameter impeller would have about a 1.3 inches (33 mm) thick front shroud whilst a 40 inch (1-meter) diameter impeller would be around 1.65 inches (42 mm).

In an embodiment, the particles are diverted as closely as possible to the inside of the clearing vanes 8. The clearing vanes 8 are relieved or stopped off at their inside diameter to form a recess or relief 19. The stationary or circular diverter can take up this relief as closely as possible allowing a practical running clearance of about 2.5 mm for 0.5-meter diameter impeller and 0.5 mm for smaller impellers.

The shape of the diverter 2 on its outer diameter may be radial or near radial, while on the inside it may be set at about a 45 degree angle to minimize the wear effect of particles being thrown off the impeller. The diverter 2 nose may extend out as close as practical to the impeller front shroud 10. The clearance under the diverter 2 and between the rotating impeller surface may be kept somewhat larger at around 25% to about 100% of the shroud thickness.

A protruding piece 2 extends out from the suction liner face 4 near and/or under the inside of the clearing vanes on a slurry pump impeller to divert particles to the impeller front clearing vanes which will cause particles to be pumped back into the main volute collector 22 reducing the concentration, size and/or number of particles that go through the lower sealing nose gap 12 thereby reducing wear in this high nose gap wear area. A protrusion 2 on the suction liner will divert abrasive particles away from the liner and improve wear.

Figure 2:
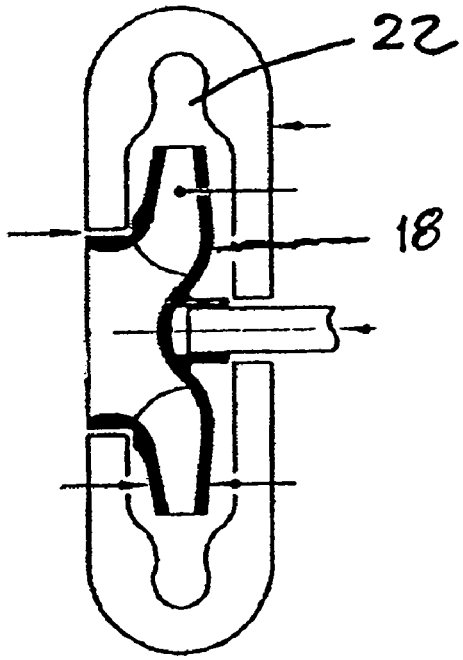
Fig. 2 PRIOR ART
FIG. 2 is a cross-sectional view of a single stage, single suction pump with shrouds on the front and back of the impeller.

Referring now in greater detail to the figures, wherein like numerals refer to like parts throughout the drawings. In FIG. 1 an embodiment of a centrifugal pump 20 is illustrated showing the discharge nozzle, inlet, impeller and the flow of the slurry in the pump as indicatedby the arrows. FIG. 2 is a further embodiment of acentrifugal pump illustrating the impeller vanes connected to a shaft by which theimpeller vanes are turned within the collector or shell that houses the vanes. The vanes have an impeller shroud front and an impeller shroud back. The front side of the pump is labeled as the suction end of the centrifugal pump. The impeller nose gap 12 is located at the meeting of the impeller and collector.

Figure 3:
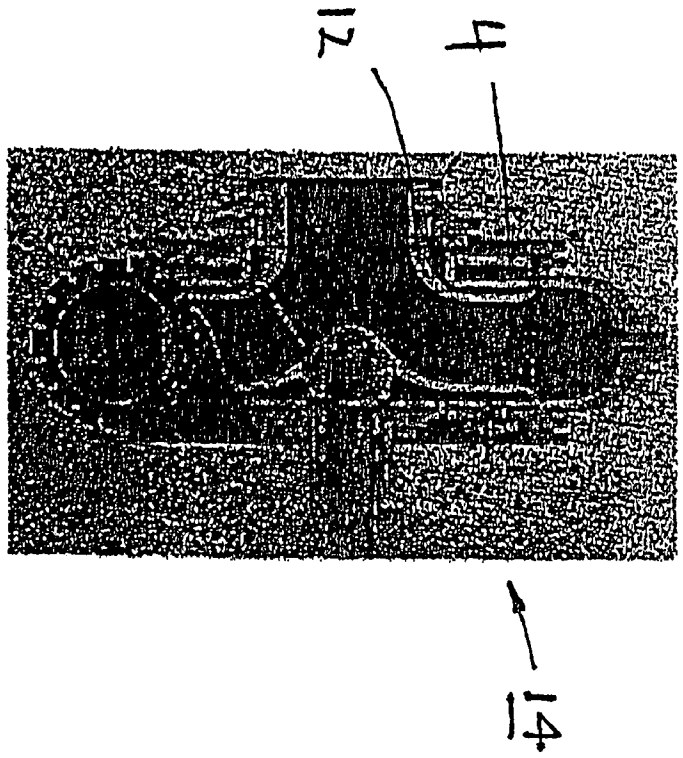
Fig. 3 PRIOR ART
FIG. 3 is a cross-sectional view of a slurry pump.
Figure 4:
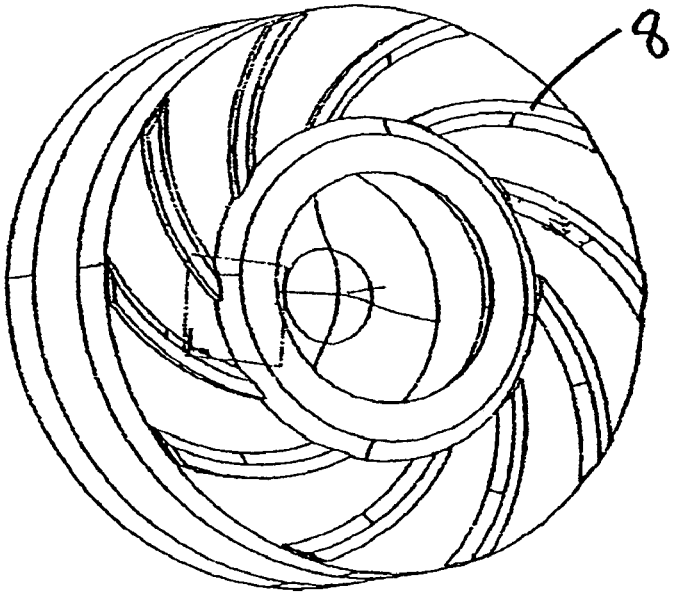
Fig. 4 PRIOR ART
FIG. 4 illustrates an impeller with clearing vanes.
Figure 5:
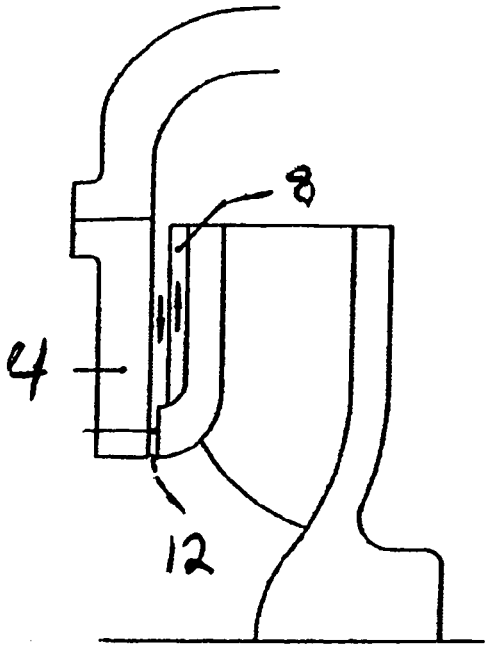
FIG. 5 PRIOR ART
FIG. 5 illustrates the close clearance between the suction liner and the clearing vanes.

FIG. 3 further depicts a centrifugal pump 14 in greater detail such that a water flush inlet along with the impeller nose gap 12 is illustrated. Further illustrated is a suction liner 4 without the diverter 2 extending from the suction liner. Also shown is the connection shaft, suction inlet and outlet. FIG. 4 illustrated the clearing vanes 8 protruding from the impeller front shroud 10 for clearing the particles from the suction liner 4 and the impeller nose gap. FIG. 5 depicts the impeller nose gap 12 and the suction liner 4 without a diverter. Further illustrated is the movement of the particles by the arrows as some of the particles pass up through the clearing vanes and the remaining particles passing through the impeller nose gap 12.

Figure 6:
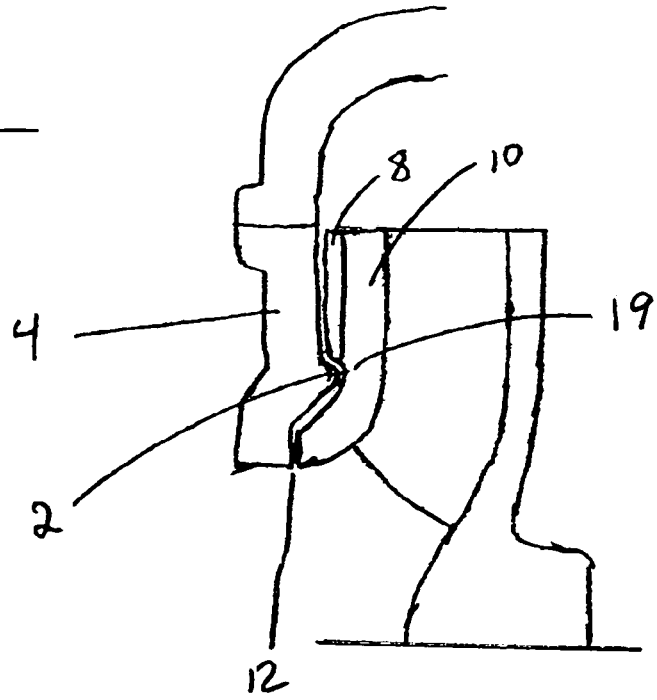
FIG. 6 shows the diverter used to reduce the number of particles that go through the gap to cause wear.
Figure 7:
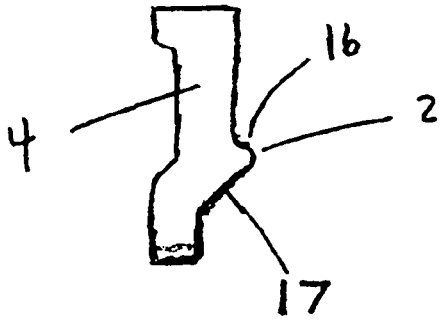
FIG. 7 shows the diverter extending from the suction liner.

FIGS. 6 and 7 illustrate the diverter 2. In FIG. 6 the suction liner 4 having the diverter protrusion 2 extending from the liner and out to a recess in the clearing vanes 8 attached to the impeller front shroud 10 is illustrated. FIG. 7 illustrates the suction liner 4 and diverter 2. The diverter 2 or protrusion comprises an outer edge which is illustrated as substantially rounded 16 and an inner edge 17 set at an angle of about 45°.

What is claimed is:

1. A diverter for reducing particulate wear in a slurry pump having a suction liner, an impeller with a front shroud, and a nose gap having a diameter between the suction liner and the front shroud of the impeller, the diverter comprising:

(a) a suction liner face having a protrusion formed upstream of the nose gap, wherein the protrusion has a diameter greater than the diameter of the nose gap, the protrusion extending inwardly toward the front shroud of the impeller and terminating in a substantially rounded tip;

(b) an impeller front shroud being operatively opposed to the suction liner face, a rounded relief formed within the front shroud; and (c) the rounded tip of the protrusion extending into, but not contacting, the rounded relief of the front shroud, wherein particulate matter is deflected away from the suction liner face upstream of the nose gap.

2. The diverter of claim 1 wherein the protrusion includes an inner edge, the inner edge extending downwardly from the rounded tip to the suction liner face at an angle of about 45 degrees from horizontal.

3. A diverter for reducing particulate wear in a slurry pump having a suction liner, an impeller with a front shroud and clearing vanes, and a nose gap having a diameter between the suction liner and the front shroud of the impeller, the diverter comprising:

(a) a suction liner face having a protrusion formed upstream of the nose gap, wherein the protrusion has a diameter greater than the diameter of the nose gap, the protrusion extending inwardly toward the front shroud of the impeller and terminating in a substantially rounded tip;

(b) the clearing vanes of the front shroud being operatively opposed to the suction liner face, a rounded relief formed within the clearing vanes; and (c) the rounded tip of the protrusion extending into, but not contacting, the rounded relief of the clearing vanes, wherein particulate matter is deflected away from the suction liner face upstream of the nose gap.

4. The diverter of claim 3 wherein the protrusion includes an inner edge, the inner edge extending downwardly from the rounded tip to the suction liner face at an angle of about 45 degrees from horizontal.

5. A slurry pump, comprising:

(a) a suction liner having a face;

(b) an impeller having a front shroud;

(c) a nose gap between the suction and the front shroud, the nose gap having a diameter;

(d) a diverter for reducing particulate wear, comprising:

(i) a protrusion formed on the suction liner face upstream of the nose gap, wherein the protrusion has a diameter greater than the diameter of the nose gap, the protrusion extending inwardly toward the front shroud of the impeller and terminating in a substantially rounded tip;

(ii) the impeller front shroud being operatively opposed to the suction liner face, a rounded relief formed within the front shroud; and (iii) the rounded tip of the protrusion extending into, but not contacting, the rounded relief of the front shroud, wherein particulate matter is deflected away from the suction liner face upstream of the nose gap.

6. The slurry pump of claim 5 wherein the impeller front shroud comprises clearing vanes, the rounded relief formed within the clearing vanes.

7. The slurry pump of claim 5 wherein the protrusion includes an inner edge, the inner edge extending downwardly from the rounded tip to the suction liner face at an angle of about 45 degrees from horizontal.

* * * * *